US006451494B1

(12) United States Patent
Kabai

(10) Patent No.: US 6,451,494 B1
(45) Date of Patent: Sep. 17, 2002

(54) DEVELOPING AGENT AND METHOD FOR MANUFACTURING THE SAME

(75) Inventor: Takahito Kabai, Yokohama (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/867,553

(22) Filed: May 31, 2001

(51) Int. Cl.[7] ..... G03G 9/087

(52) U.S. Cl. ..... 430/108.21; 430/109.3; 430/126; 430/137.2

(58) Field of Search ..... 430/108.21, 109.3, 430/66, 96, 126, 137.2

(56) References Cited

U.S. PATENT DOCUMENTS 5,572,311 A * 11/1996 Abe et al. ..... 399/127
6,080,902 A * 6/2000 Herrmann et al. ..... 585/512
6,153,347 A * 11/2000 Kabai et al. ..... 430/108.4

FOREIGN PATENT DOCUMENTS

JP 5-181307 7/1993

OTHER PUBLICATIONS

TOPAS: A new material for high quality printing, The 9$^{th}$ Ticona GmbH, Nov. 29, 2000.

* cited by examiner

*Primary Examiner*—John Goodrow
(74) *Attorney, Agent, or Firm*—Foley & Lardner

(57) ABSTRACT

Disclosed is a developing agent comprising toner particles including a binder resin mainly containing an ethylene-norbornene copolymer and a coloring agent mainly containing a cyanine dye and an organic boron ammonium salt. The developing agent can be decolored by irradiation with light having a predetermined wavelength region.

12 Claims, 2 Drawing Sheets

DEVELOPING AGENT AND METHOD FOR MANUFACTURING THE SAME

BACKGROUND OF THE INVENTION

These days, in view of the problems related to the environment, copy paper is being reused much more than previously.

In general, after copy paper is used, it can be used as a raw material for recycled paper. In order to obtain a regenerated paper sheet from such a waste paper raw material, it was necessary to pulverize finely the waste paper raw material to a fibrous state, followed by applying paper making technology. Therefore, large facilities were required. Also, it was difficult to separate the developing agent from the paper. In addition, since the paper fiber was made shorter, it was necessary to use various additives such as a bleaching agent and an adhesive. Such being the situation, the regenerated paper sheet was not satisfactory in quality regardless of the recovery or recycling cost.

Under the circumstances, studies are being made in recent years on the use of a developing agent containing a pigment or a dye that brings about a decoloration reaction upon irradiation with light having a predetermined wavelength so as to achieve decoloration. In the case of using such a developing agent, the image formed on the copying paper sheet after use can be eliminated by simply irradiating the copying paper sheet with light, making it possible to use repeatedly the copying paper sheet without markedly degrading the paper sheet quality. Also, it is unnecessary to use large facilities and to mix various additives.

However, the light irradiation for a long time was required for sufficiently erasing the image formed on the used copying sheet, making it difficult to put the particular method into practical use.

One of the causes of the requirement of the light irradiation for a long time is that the irradiating light is attenuated before the irradiating light reaches the pigment or dye capable of decoloration and, thus, it is difficult for the irradiating light to reach a deep portion of the image formed on the used copying paper sheet.

The attenuation of the irradiating light is considered to be caused by the light absorption by the binder resin, the scattering of the irradiating light caused by the irregular surface of the image formed on the used copying paper sheet, the scattering and the absorption of the irradiating light caused on the surface of the developing agent, and the interface between the developing agents and the insufficient dispersion of the pigment or dye in the binder resin.

BRIEF SUMMARY OF THE INVENTION

A first object of the present invention, which has been achieved in an attempt to overcome the above-noted problems inherent in the prior art, is to provide a developing agent capable of easily achieving the decoloration in a short time by simply irradiating the used copying paper sheet with light having a predetermined wavelength.

A second object of the present invention is to provide a method of manufacturing a developing agent capable of easily achieving the decoloration in a short time by simply irradiating the used copying paper sheet with light having a predetermined wavelength.

Further, a third object of the present invention is to provide a method of forming an image by using a developing agent capable of easily achieving the decoloration in a short time by simply irradiating the used copying paper sheet with light having a predetermined wavelength.

According to a first aspect of the present invention, there is provided a developing agent containing toner particles including a binder resin mainly containing an ethylene-norbornene copolymer and a coloring agent mainly containing a cyanine dye and an organic boron ammonium salt.

According to a second aspect of the present invention, there is provided a method of manufacturing a developing agent, comprising the steps of melting and kneading toner particle materials including a binder resin mainly containing an ethylene-norbornene copolymer and a coloring agent mainly containing a cyanine dye and an organic boron ammonium salt to obtain a kneaded mass; and pulverizing and classifying the kneaded mass to obtain toner particles.

Further, according to a third aspect of the present invention, there is provided a method of forming an image, comprising the steps of supplying a developing agent containing toner particles including a binder resin mainly containing an ethylene-norbornene copolymer and a coloring agent mainly containing a cyanine dye and an organic boron ammonium salt, onto an image carrier so as to develop the electrostatic latent image formed on the image carrier and, thus, to obtain a developing agent image; transferring the developing agent image onto a transfer material; and fixing the transferred developing agent image.

According to the present invention, an ethylene-norbornene copolymer having a high transparency is used as a binder resin, making it possible to permit the irradiating light to reach the coloring agent efficiently. As a result, it is possible to obtain a developing agent capable of an efficient decoloration by the light irradiation for a short time. The copying paper sheet having an image formed thereon by using the particular developing agent of the present invention can be decolored easily and, thus, can be reused promptly. It follows that the present invention permits realizing the saving of natural resources and a cost reduction.

Additional objects and advantages of the invention will be set forth in the description which follows, and in part will be obvious from the description, or may be learned by practice of the invention. The objects and advantages of the present invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the present invention.

DETAILED DESCRIPTION OF THE INVENTION

Figure 1:
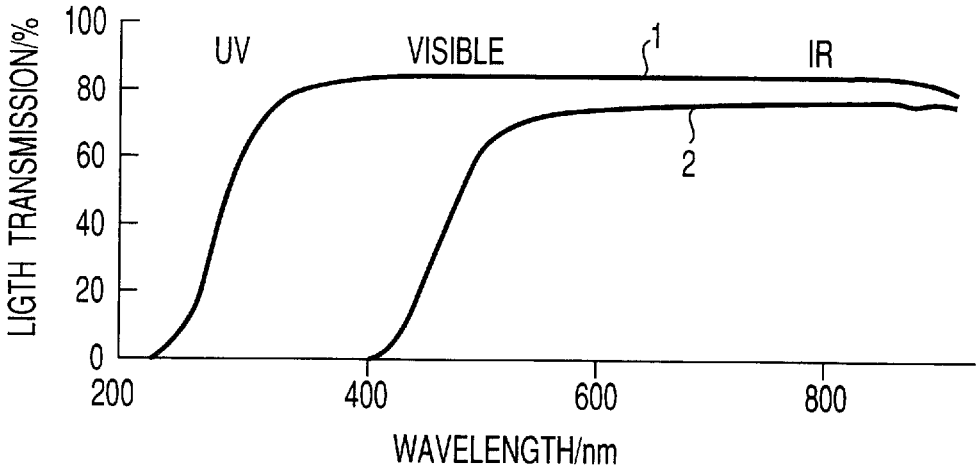
FIG. 1 is a graph showing the light transmittance of an ethylene-norbornene copolymer relative to the wavelength of the irradiating light used in the present invention.

The present invention provides a developing agent containing toner particles including a binder resin and a coloring agent in which and the binder resin used in the present invention mainly contains an ethylene-norbornene copolymer, and the coloring agent used in the present invention mainly contains a cyanine dye and an organic boron ammonium salt.

The present invention also provides a method of manufacturing a developing agent, comprising the steps of obtaining a kneaded mass by melting and kneading a toner particle material containing a binder resin and a coloring agent, pulverizing and classifying the kneaded mass to obtain toner particles, and the toner particle material used in the method of the present invention comprises a binder resin mainly containing an ethylene-norbornene copolymer and a coloring agent mainly containing a cyanine dye and an organic boron ammonium salt.

The developing agent of the present invention can be decolored by irradiation with light having a predetermined wavelength region. Particularly, according to the present invention the ethylene-norbornene copolymer having a high transparency is used as a binder resin so as to improve the light transmittance of the binder resin. As a result, the light absorption by the binder resin can be suppressed so as to permit the irradiating light to reach easily a deep portion of the image formed on a transfer material. It follows that the coloring agent containing the cyanine dye and the organic boron ammonium salt dispersed in the binder resin is irradiated efficiently with light so as to generate easily the decoloration reaction. Such being the situation, the color of the developing agent can be erased sufficiently by the light irradiation for a short time in the case of using the developing agent of the present invention.

Further, the present invention provides an image forming method, comprising the steps of forming a developing agent image by supplying a developing agent onto an image carrier so as to develop the electrostatic latent image formed on the image carrier, transferring the developing agent image onto a transfer material, and fixing the transferred developing agent image. The developing agent used in the image forming method of the present invention contains toner particles including a binder resin mainly containing an ethylene-norbornene copolymer and a coloring agent mainly containing a cyanine dye and an organic boron ammonium salt.

In the image forming method of the present invention, it is possible to use as the transfer material an unused transfer material or a transfer material prepared by applying a decoloring treatment of irradiation with light having a predetermined wavelength region to the used transfer material having an image formed thereon by using the developing agent of the present invention.

It is also possible to add a decoloring step to the image forming method of the present invention. The image forming method including the decoloring treatment comprises, for example, the steps of irradiating a transfer material having an image formed thereon, by using a developing agent containing toner particles including a binder resin mainly containing an ethylene-norbornene copolymer and a coloring agent mainly containing a cyanine dye and an organic boron ammonium salt, with light having a wavelength region capable of decoloring the coloring agent to decolor the coloring agent, supplying the developing agent onto an image carrier and developing an electrostatic latent image formed on the image carrier to form a developing agent image, transferring the developing agent image onto the transfer material having the decoloring treatment applied thereto in advance, and fixing the transferred developing agent image.

The image formed by using the developing agent of the present invention can be decolored sufficiently by the light irradiation for a short time and, thus, the developing agent of the present invention is highly practical. It follows that the present invention permits reusing the transfer material such as a copying paper sheet in an office so as to achieve saving of natural resources and a cost reduction.

The ethylene-norbornene copolymer used in the present invention is represented by structural formulas (1) and (2) given below:

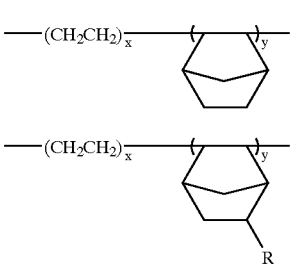

The molecular weight distribution can be designed freely in the ethylene-norbornene copolymer used in the present invention, making it possible to obtain relatively easily the melting characteristics required for the fixing.

FIG. 1 is a graph showing the light transmittance of the ethylene-norbornene copolymer relative to the wavelength of the irradiating light (curve 1). FIG. 1 also shows, for comparison, curve 2 representing the light transmittance of a polyester resin. As apparent from the graph of FIG. 1, the ethylene-norbornene copolymer used in the present invention exhibits a further excellent light transmittance over a wide range of wavelengths, compared with the polyester resin exhibiting a relatively high transparency. Therefore, when the ethylene-norbornene copolymer is used as a binder resin, the irradiating light is not absorbed by the binder resin and, thus, is not attenuated, with the result that the irradiating light reaches the coloring agent inside the toner particle.

The attenuation of the irradiating light is also caused by the scattering of the irradiating light on the irregular surface of the image, and by the scattering and absorption of the irradiating light by the toner particles forming the image and at the interface between the toner particles. In order to suppress the light attenuation, it is conceivable to sufficiently melt the toner particles in the fixing step so as to integrate the toner particles within the image as possible. By making the integrated developing agent image, surface irregularities of the image can be suppressed and the interface of the developing agent can be eliminated so as to suppress the scattering and absorption of the irradiating light.

In order to sufficiently melt the toner particles in the fixing step, it is desirable to lower the melting point of the toner binder. Since the molecular weight distribution of the ethylene-norbornene copolymer can be designed freely, it is desirable to use the ethylene-norbornene copolymer as the binder resin in this respect, too.

It is preferable for the ethylene-norbornene copolymer used in the present invention to have a softening point falling within a range of between 90° C. and 120° C., more preferable between 100° C. and 110° C. If the softening point falls within the preferable range, the transparency of the binder resin can be improved. Also, it is possible to obtain the melting characteristics required for the sufficient fixation of the developing agent image. In addition, the storing properties of the developing agent can be improved. However, if the softening point is lower than 90° C., the storing properties of the developing agent tends to be rendered poor. On the other hand, if the softening point exceeds 120° C., it tends to be difficult to sufficiently melt the developing agent, with the result that the transparency of the developing agent tends to be impaired.

Incidentally, it is referred to "½ drop temperature" as the softening point of the ethylene-norbornene copolymer used in the present invention. The temperature at the point in a flow curve a plunger drop amount becomes ½ measured by using a flow tester CFT 500 manufactured by Shimazu K.K. is defined as the "½ drop temperature".

Figure 2:
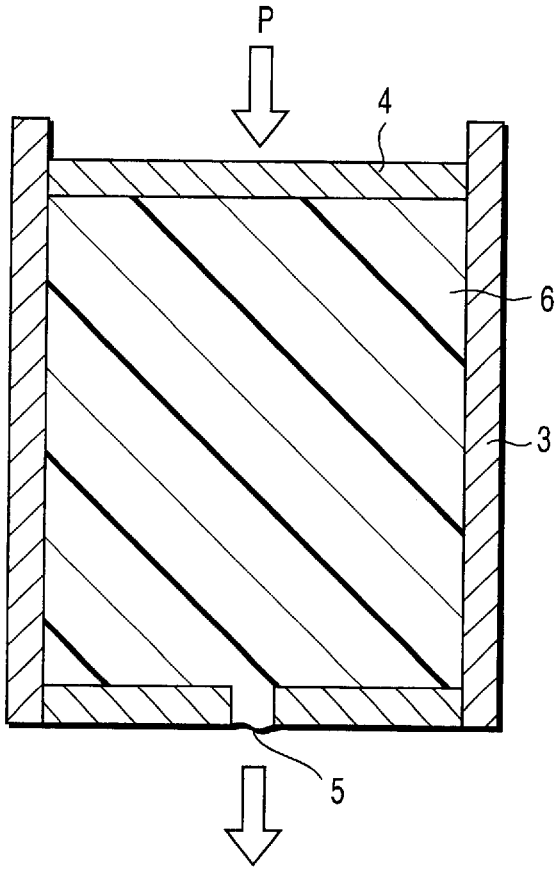
FIG. 2 schematically shows the construction of a flow tester.

FIG. 2 schematically shows the construction of the flow tester. As shown in the drawing, the flow tester includes a cylinder 3 having a die 5 mounted at one end and a plunger 4 mounted at the other end. Loaded in the cylinder 3 is 1 g of a sample 6. A pressure is applied to the plunger 4 while heating the cylinder 3 at a rate of 6° C./min. The pressure is of 20 kg. When a predetermined temperature has been reached, the sample 6 is melted and begins to flow out of the die 5. In accordance with the temperature elevation, the sample 6 flows out completely and the downward movement of the plunger 4 is stopped. The temperature at the time the plunger 4 has moved half the vertical distance of the cylinder 3 is defined as the ½ drop temperature, providing the softening point of the ethylene-norbornene copolymer used in the present invention.

The cyanine dye and the organic boron ammonium salt used in the present invention carry out a decoloration reaction when irradiated with light having a predetermined wavelength.

The decoloration reaction is as exemplified below:

Reaction formula 3:

(3)

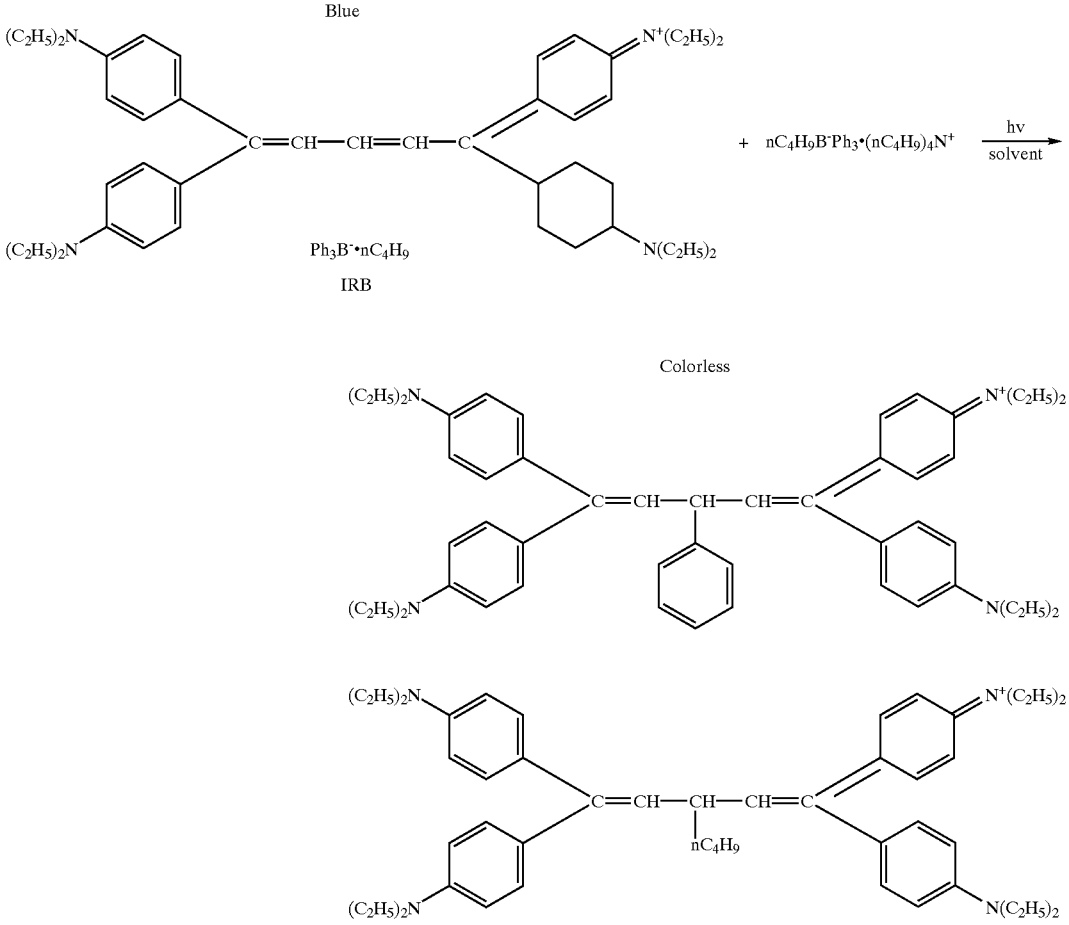

If a cyanine series dye and an organic boron ammonium salt, e.g., tetrabutyl ammonium butyl triphenyl borate, are present together, a near infrared ray having a wavelength of, for example, about 820 nm is absorbed to perform a decoloration. In this case, the cyanine dye is excited by light, and the coloring matter is reduced by the electron transferred from the borate, with the result that two kinds of colorless leuco bodies are considered to be generated as shown in reaction formula 1 given above.

Table 1 shows the structural formulas of the cyanine series dyes that can be used in the present invention and the wavelength of light causing the dyes to carry out the decoloration reaction.

TABLE 1

| Structural formula | λ max (nm) |
|---|---|
| get,,0001 | 828 |
| get,,0002 | 819 |
| get,,0003 | 874 |
| get,,0004 | 785 |
| get,,0005 | 820 |

If an image formed by printing of an electrophotographic toner containing the cyanine series dye and the organic boron ammonium salt described is irradiated with a near infrared ray having a predetermined wavelength region, it is possible to erase the image by the decoloration reaction similar to that shown in reaction formula 1. The copying paper sheet having the image erased therefrom can be reused so as to decrease the waste amount of the copying paper sheet after use, a waste amount which has been increasing in recent years in office documents.

In the method of the present invention for manufacturing a developing agent, it is possible to employ a master batch processing for enhancing the dispersion of the coloring agent used. In the master batch processing, a mixture consisting of some of the toner particle materials, i.e., a mixture consisting of the coloring agent and a part amount of the binder resin is melted and kneaded in advance so as to prepare a master batch, followed by melting and kneading a mixture comprising the master batch and another part amount of the binder resin so as to obtain a kneaded mass.

For example, a mixture comprising of 30% by weight of a coloring agent and 70% by weight of a binder resin is melted and kneaded by a pressurizing kneader, followed by further melting and kneading the kneaded mass by using a three-roll mill. It is also possible to use kneading equipment such as a Banbury mixer, a twin roll, or a kneadex. Further, it is possible to employ a so-called "brushing method", in which a water-containing pigment is used for the master batch processing.

Figure 3:
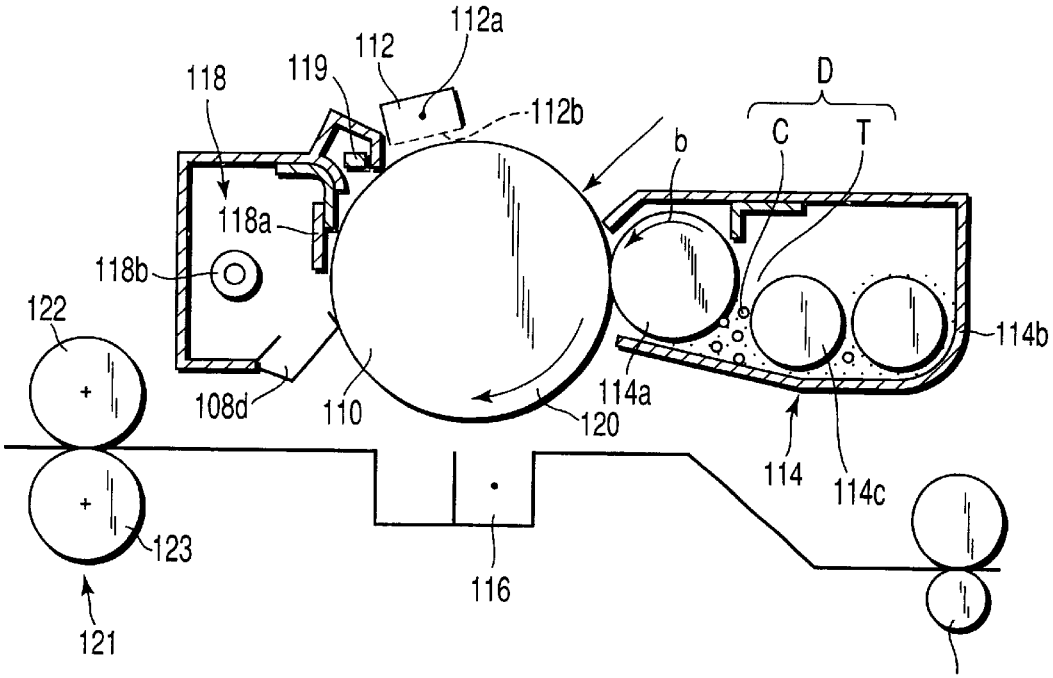
FIG. 3 schematically shows as an example of the construction of an image forming apparatus used in the present invention.

FIG. 3 exemplifies an image forming apparatus in which the developing agent of the present invention can be used. As shown in the drawing, a developing device 114 is arranged to face an image carrier (photoreceptor drum) 110 that is arranged rotatable. The photoreceptor drum 110 is rotated by a main motor (not shown) in the direction denoted by an arrow 120. An electrostatic latent image corresponding to the image information to be recorded is formed on the surface of the photoreceptor drum 110 by a laser beam emitted from a laser light exposure apparatus arranged separately.

Arranged around the photoreceptor drum 110 in the order mentioned in the direction denoted by the arrow 120 are a charging device 112 for charging the photo receptor drum 110 at a predetermined potential, the developing device 114 for developing the electrostatic latent image by supplying a toner to the electrostatic latent image formed on the surface of the photoreceptor drum 110 by a laser light exposure apparatus arranged separately, a paper feeding section 56*a* for feeding a paper sheet to the photoreceptor drum 110, a transfer device 116 for transferring the developing agent image formed on the photoreceptor drum 110 by the developing device 114 onto the fed paper sheet, a cleaning device 118 for scraping off the residual toner on the surface of the photoreceptor drum 110, i.e., the toner that has not been transferred onto the paper sheet, and a destaticizer 119 for removing the charge remaining on the surface of the photoreceptor drum 110 in the order mentioned.

FIG. 3 shows that the destaticizer 119 is formed integral with the housing of the cleaning device 118. However, it is possible to arrange the destaticizer 119 separately. Also, it is possible to arrange a toner destaticizer 117 for facilitating the cleaning of the residual toner between the cleaning device 118 and the transfer device 116. Further, it is possible to arrange another destaticizer (not shown) for facilitating the toner transfer onto the paper sheet between the developing device 114 and the transfer device 116.

The cleaning device 118 includes a drum holding section for supporting the photoreceptor drum 110 when the photoreceptor drum 110 is mounted on the image forming apparatus and, thus, can also be utilized as a drum holding member.

The charging device 112 includes a corona wire 112*a* and a grid screen 112*b*, which are connected to a high voltage circuit (not shown) and a grid bias voltage generating device (not shown) for charging the surface of the photoreceptor drum 110 at a predetermined surface potential.

Housed in the developing device 114 is a toner T containing toner particles and an optional additive, said toner particles containing a binder resin mainly containing an ethylene-norbornene copolymer and a coloring agent mainly containing a cyanine dye and an organic boron ammonium salt. By using a developing agent D prepared by mixing the toner T and a magnetic carrier C covered with an insulating resin at a predetermined mixing ratio, a magnetic brush is formed on a developing roller 114*a* supporting the developing agent D. The magnetic brush thus formed is brought into contact with the photoreceptor drum 110 arranged to face the developing roller 114*a* so as to develop the electrostatic latent image formed on the photoreceptor drum 110. Incidentally, the developing agent D and the developing roller 114*a* are housed in a housing 114*b*. Guide rollers 114*c* for maintaining constant the distance between the surface of a nonmagnetic sleeve forming the outer circumferential surface of the developing roller 114*a* and the surface of the photoreceptor drum 110 are arranged at both edge portions in the longitudinal direction of the developing roller 114*a*. It is also possible to maintain constant the distance noted above by bonding or coating a material having a predetermined thickness or by bonding or coating a material having a predetermined thickness to the edge portion of the photoreceptor drum in place of arranging the guide rollers 114*c*. As a result, the distance between the surface of the developing sleeve and the photosensitive layer of the photoreceptor drum is kept constant.

Incidentally, a magnetic medium in which a plurality of stationary magnets having S- and N-poles are arranged a predetermined angular distance apart from each other in the circumferential direction is mounted in the developing sleeve of the developing roller 114*a*.

In developing the electrostatic latent image formed on the surface of the photoreceptor drum 110, the toner attached by an image force to the ears constituted by the carriers formed on the sleeve along the magnetic lines of force generated from the main pole of the magnet medium is moved by the electric field formed by the potential of the electrostatic latent image formed on the photoreceptor drum 110 and the developing bias voltage in the developing region in which the photoreceptor drum 110 faces the developing roller 114*a*. As a result, the electrostatic latent image is developed so as to obtain a developing agent image.

The developing agent image thus obtained is transferred by the transfer device 116 onto a transfer material such as a paper sheet. Then, the transfer material bearing the developing agent image is transferred into a fixing device 121 including a heat roller 122 and a pressurizing roller 123, thereby fixing the developing agent image to the transfer material.

Figure 4:
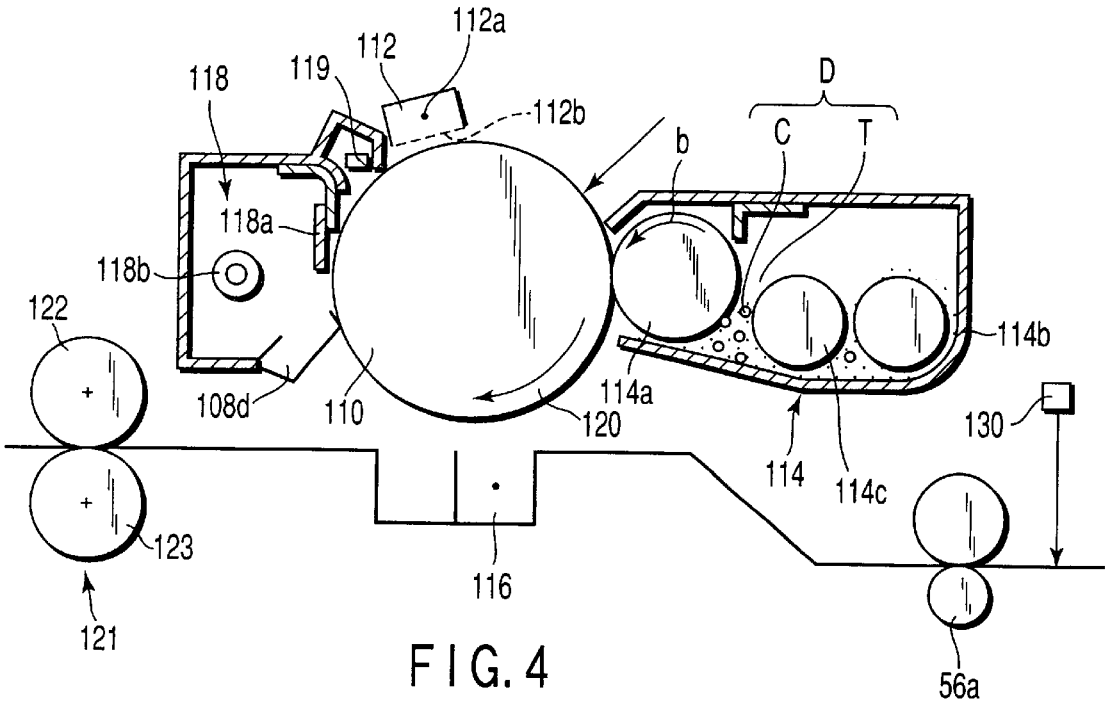
FIG. 4 schematically shows another example of the construction of an image forming apparatus used in the present invention.

FIG. 4 s hows a modification of the apparatus shown in FIG. 3. The apparatus shown in FIG. 4 is equal to the apparatus shown in FIG. 3, except that a decoloration treating section 130 for performing a decoloring treatment by irradiating with light having a wavelength region capable of decoloring the image is arranged upstream of the paper sheet feeding section 56*a* in the apparatus shown in FIG. 4.

If a used copying paper sheet having an image formed thereon by using the developing agent of the present invention is applied to the image forming apparatus shown in FIG. 4, the used copying paper sheet is irradiated with light having a wavelength region capable of decoloration in the decoloration treating section 130 so as to carry out easily the decoloration treatment of t he image. The paper sheet subjected to the decoloration treatment can be used for image forming as the unused paper sheet. It follows that the apparatus shown in FIG. 4 makes it possible to easily reuse the used copying paper sheet, making it possible to achieve a saving of natural resources and a cost reduction.

In the present invention, it is possible to use various colorless additives that do not impair the decoloring reaction. For example, it is possible to use charge control agents CCA such as complexes of Cr, Zn, Zr, B, etc., resin type charge regulating agents CCR, and releasing agents such as polypropylene, polyester, natural or synthesized monoesters, metal soaps and higher fatty acids.

The present invention will now be described in more detail with reference to Examples of the present invention.

EXAMPLE 1

In the first step, toner particle materials were prepared as follows.

| Composition of Toner Particle Materials: | |
|---|---|
| Binder resin consisting of ethylene-norbornene copolymer having a softening point of 140° C. | 90 parts by weight |

-continued

| Composition of Toner Particle Materials: | |
|---|---|
| Cyanine dye represented by structural formula (4) given below | 5 parts by weight |

(4)

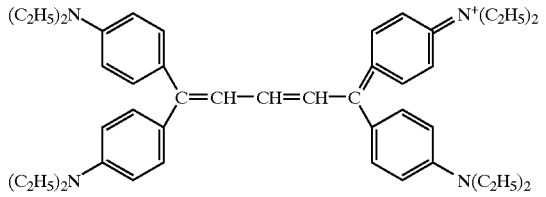

$Ph_3B^-{\bullet}nC_4H_9$

| | |
|---|---|
| Organic boron compound represented by structural formula (5) given below | 5 parts by weight |

(5)

$nC_4H_9B^-Ph_3{\bullet}(nC_4H_9)_4N^+$

The toner particle materials given above were mixed by a Henschel mixer manufactured by Mitui Kozan K.K., followed by melting and kneading the mixture by using a continuous kneader.

The kneaded mass was roughly pulverized by using a pin mill, followed by further pulverizing the roughly pulverized material into particles sized at 10 $\mu$m by using an I-type jet mill manufactured by Hosokawa Micron K.K. so as to obtain toner particles. Further, toner was obtained by adding 0.5% by weight of hydrophobic silica to the toner particles by using a Henschel mixer. Still further, a developing agent was obtained by mixing 95% by weight of a ferrite carrier covered with a silicone resin to 5% by weight with the toner.

The developing agent thus prepared was used in a copying machine Premarju 3850 manufactured by Toshiba Corporation so as to perform a copying operation. The image density of the obtained image was found to be 1.2 when measured with a Mcbeth densitometer RD 918 (Mcbeth).

Further, the obtained image was irradiated with light having a wavelength of 820 nm so as to measure the irradiating time required for lowering the image density to 0.4. The required irradiating time was found to be 5 hours, as shown in Table 2.

EXAMPLES 2, 3 AND COMPARATIVE EXAMPLES 1, 2

A developing agent was prepared as in Example 1, except that the binder resins used were as shown in Table 2. The image density was measured for each of the prepared developing agents.

The time required for lowering the image density to 0.4 was measured for each of the images formed by using the obtained developing agents, with the results as shown in Table 2.

EXAMPLE 4

A master batch material of the composition given below was prepared.

| | |
|---|---|
| Binder resin: | |
| Ethylene-norbornene copolymer having a softening point of 120° C. | 20 parts by weight |
| Coloring agent 1: | |
| Cyanine dye represented by structural formula (4) given previously | 5 parts by weight |
| Coloring agent 2: | |
| Organic boron compound represented by structural formula (5) given previously | 5 parts by weight |

A developing agent was prepared as in Example 1, except that the master batch material given above was melted and kneaded by a twin roll, followed by adding 70 parts by weight of the remaining binder resin and further melting and kneading the resultant composition by using a continuous kneading machine so as to obtain a kneaded mass. An image density of the developing agent thus prepared was measured as in Example 1. Also, the time required for decoloring the image was measured, with the result as shown in Table 2.

COMPARATIVE EXAMPLE 3

A developing agent was prepared as in Example 4, except that used was a binder resin shown in Table 2. An image density of the developing agent thus prepared was measured as in Example 1. Also, the time required for decoloring the image was measured, with the result as shown in Table 2.

TABLE 2

| | Binder resin | Softening point Tm (° C.) | Coloring agent 1 | Coloring agent 2 | Master batch processing | Wavelength (nm) | Irradiating time (hours) |
|---|---|---|---|---|---|---|---|
| Comparative Example 1 | Polyester | 140 | Cyanine dye of formula (4) | Organic boron compound of formula (5) | None | 820 | 18 |
| Comparative Example 2 | Polyester | 110 | ↑ | ↑ | None | ↑ | 12 |
| Comparative Example 3 | Polyester | 110 | ↑ | ↑ | Processed | ↑ | 10 |
| Example 1 | Ethylene-norbornene copolymer | 140 | ↑ | ↑ | None | ↑ | 5 |
| Example 2 | ↑ | 120 | ↑ | ↑ | None | ↑ | 3 |
| Example 3 | ↑ | 110 | ↑ | ↑ | None | ↑ | 3 |
| Example 4 | ↑ | 110 | ↑ | ↑ | Processed | ↑ | 2 |

As apparent from the comparison between Comparative Examples 1 and 2 shown in Table 2, it has been clarified that the irradiating time required for the decoloration can be shortened by lowering the softening point of the binder resin. It is considered reasonable to understand that, if the softening point of the binder resin is lowered, the toner image is made integral in the fixing process so as to suppress the scattering and absorption of the irradiating light. However, a long irradiating time of 10 hours was required for the decoloration even in Comparative Example 2.

It has also been clarified by the comparison between Comparative Examples 2 and 3 that the irradiating time required for the decoloration can be shortened by applying a master batch processing to the coloring agent. It is considered reasonable to understand that the dispersion of the coloring agent is improved by the master batch processing so as to permit the irradiating light to reach a deep portion of the toner image.

Further, it has been clarified that the irradiating time required for the decoloration can be markedly shortened to only 3 hours in Example 1 using the ethylene-norbornene copolymer. It is considered reasonable to understand that, since the ethylene-norbornene copolymer has a high transparency, the irradiating light efficiently reaches the coloring agent so as to markedly shorten the irradiating time required for the decoloration. Further, Examples 2, 3 and 4 support that the irradiating time required for the decoloration can be further shortened by setting the softening point of the binder resin at a level not higher than 120° C.

What is claimed is:

1. A developing agent comprising toner particles including a binder resin mainly containing an ethylene-norbornene copolymer and a coloring agent mainly containing a cyanine dye and an organic boron ammonium salt.

2. The developing agent according to claim 1, wherein said ethylene-norbornene copolymer has a softening point falling within a range of between 90° C. and 120° C.

3. The developing agent according to claim 2, wherein said ethylene-norbornene copolymer has a softening point falling within a range of between 100° C. and 110° C.

4. A method of manufacturing a developing agent, comprising the steps of:

melting and kneading toner particle materials comprising a binder resin mainly containing an ethylene-norbornene copolymer and a coloring agent mainly containing a cyanine dye and an organic boron ammonium salt to obtain a kneaded mass; and pulverizing the kneaded mass and subsequently classifying the pulverized material to obtain toner particles.

5. The method of manufacturing a developing agent according to claim 4, wherein said coloring agent and a part amount of said binder resin in said toner particle materials are melted and kneaded in advance to prepare a master batch, followed by melting and kneading a mixture consisting of said master batch and the other part amount of said binder resin to obtain said kneaded mass.

6. The method of manufacturing a developing agent according to claim 4, wherein said ethylene-norbornene copolymer has a softening point falling within a range of between 90° C. and 120° C.

7. The method of manufacturing a developing agent according to claim 6, wherein said ethylene-norbornene copolymer has a softening point falling within a range of between 100° C. and 110° C.

8. A method of forming an image, comprising the steps of:

supplying a developing agent comprising toner particles including a binder resin mainly containing an ethylene-norbornene copolymer and a coloring agent mainly containing a cyanine dye and an organic boron ammonium salt, onto an image carrier to develop the electrostatic latent image formed on said image carrier to form a developing agent image;

transferring said developing agent image onto a transfer material; and fixing the transferred developing agent image.

9. The method of forming an image according to claim 8, wherein said transfer material is obtained by irradiating a used copying paper sheet with light having a wavelength region of a near infrared ray so as to decolor the image formed in advance on said used copying paper sheet.

10. The method of forming an image according to claim 8, wherein said coloring agent and a part amount of said binder resin in said toner particle materials are melted and kneaded in advance so as to prepare a master batch, followed by melting and kneading a mixture consisting of said master batch and the other part amount of resin so as to obtain said kneaded mass.

11. The method of forming an image according to claim 8, wherein said ethylene-norbornene copolymer has a softening point falling within a range of between 90° C. and 120° C.

12. The method of forming an image according to claim 8, wherein said ethylene-norbornene copolymer has a softening point falling within a range of between 100° C. and 110° C.

* * * * *